US009031462B2

(12) United States Patent
Mori et al.

(10) Patent No.: US 9,031,462 B2
(45) Date of Patent: May 12, 2015

(54) IMAGE FORMING APPARATUS WITH OPENING AND CLOSING DOOR

(71) Applicant: Fuji Xerox Co., Ltd., Tokyo (JP)

(72) Inventors: Masahiro Mori, Kanagawa (JP); Shuichi Yamamura, Kanagawa (JP); Kokichi Kasai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 121 days.

(21) Appl. No.: 13/890,748

(22) Filed: May 9, 2013

(65) Prior Publication Data

US 2014/0133885 A1 May 15, 2014

(30) Foreign Application Priority Data

Nov. 9, 2012 (JP) ..... 2012-247429

(51) Int. Cl.
*G03G 21/16* (2006.01)
*G03G 15/00* (2006.01)

(52) U.S. Cl.
CPC ..... *G03G 21/1633* (2013.01); *G03G 15/6514* (2013.01); *G03G 2215/00392* (2013.01); *G03G 2221/169* (2013.01); *G03G 2215/0132* (2013.01)

(58) Field of Classification Search
CPC ..... G03G 15/6514; G03G 21/1633; G03G 2215/00392; G03G 2221/1687; G03G 2221/169; G03G 2215/0132
USPC ..... 399/124, 392; 271/9.09, 213; 211/133.3; 108/1, 6, 32
See application file for complete search history.

(56) References Cited

U.S. PATENT DOCUMENTS

| | | | | |
|---|---|---|---|---|
| 6,409,166 | B1 * | 6/2002 | Kashimura | 271/213 |
| 7,382,998 | B2 * | 6/2008 | Murrell | 399/107 |
| 7,515,849 | B2 * | 4/2009 | Iketani | 399/124 |
| 8,029,129 | B2 * | 10/2011 | Hashimoto et al. | 347/108 |
| 8,712,312 | B2 * | 4/2014 | Lee et al. | 399/392 |
| 2007/0125595 | A1 | 6/2007 | Sugiyama | |
| 2010/0166474 | A1 * | 7/2010 | Suzuki | 399/405 |

FOREIGN PATENT DOCUMENTS

| | | | |
|---|---|---|---|
| JP | 11157726 | A * | 6/1999 |
| JP | 2000004319 | A * | 1/2000 |
| JP | A-2005-242168 | | 9/2005 |
| JP | A-2007-156036 | | 6/2007 |
| JP | A-2011-252959 | | 12/2011 |
| JP | A-2012-013828 | | 1/2012 |

* cited by examiner

*Primary Examiner* — Robert Beatty
(74) *Attorney, Agent, or Firm* — Oliff PLC

(57) ABSTRACT

An apparatus includes a device that includes a driving source, an opening and closing door that is opened and closed by rotational operation about a rotating shaft with respect to a body of the apparatus, and an elastic part that is provided at the body of the apparatus, that is elastically deformed by contact with a first portion of a part of the opening and closing door on the side of the rotating shaft and blocks a gap between the first portion and the body of the apparatus when the opening and closing door is closed, and that is elastically deformed by contact with a second portion of the opening and closing door that is different from the first portion when the opening and closing door is opened.

4 Claims, 9 Drawing Sheets

IMAGE FORMING APPARATUS WITH OPENING AND CLOSING DOOR

CROSS-REFERENCE TO RELATED APPLICATIONS

This application is based on and claims priority under 35 USC 119 from Japanese Patent Application No. 2012-247429 filed Nov. 9, 2012.

BACKGROUND (i) Technical Field

The present invention relates to an apparatus with an opening and closing door.

(ii) Related Art

In the related art, in apparatuses, such as an image forming apparatus, for example, the technique of reducing sound leakage during an operation is already suggested.

SUMMARY

According to an aspect of the invention, there is provided an apparatus including a device that includes a driving source, an opening and closing door that is opened and closed by rotational operation about a rotating shaft with respect to a body of the apparatus, and an elastic part that is provided at the body of the apparatus, that is elastically deformed by contact with a first portion of apart of the opening and closing door on the side of the rotating shaft and blocks a gap between the first portion and the body of the apparatus when the opening and closing door is closed, and that is elastically deformed by contact with a second portion of the opening and closing door that is different from the first portion when the opening and closing door is opened.

BRIEF DESCRIPTION OF THE DRAWINGS

Exemplary embodiments of the present invention will be described in detail based on the following figures, wherein.

DETAILED DESCRIPTION

Exemplary embodiments of the invention will be described below with reference to the drawings.

Exemplary Embodiment 1

Figure 1:
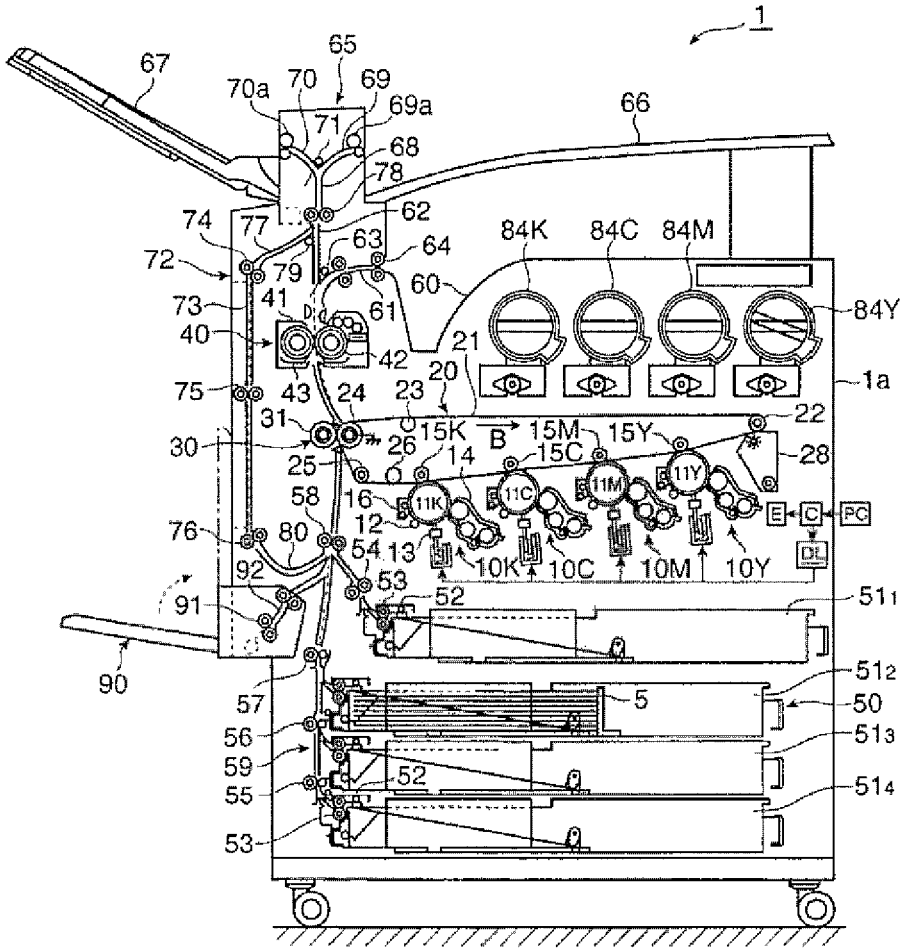
FIG. 1 is a schematic configuration view showing an image forming apparatus related to Exemplary Embodiment 1 of the invention.
Figure 2:
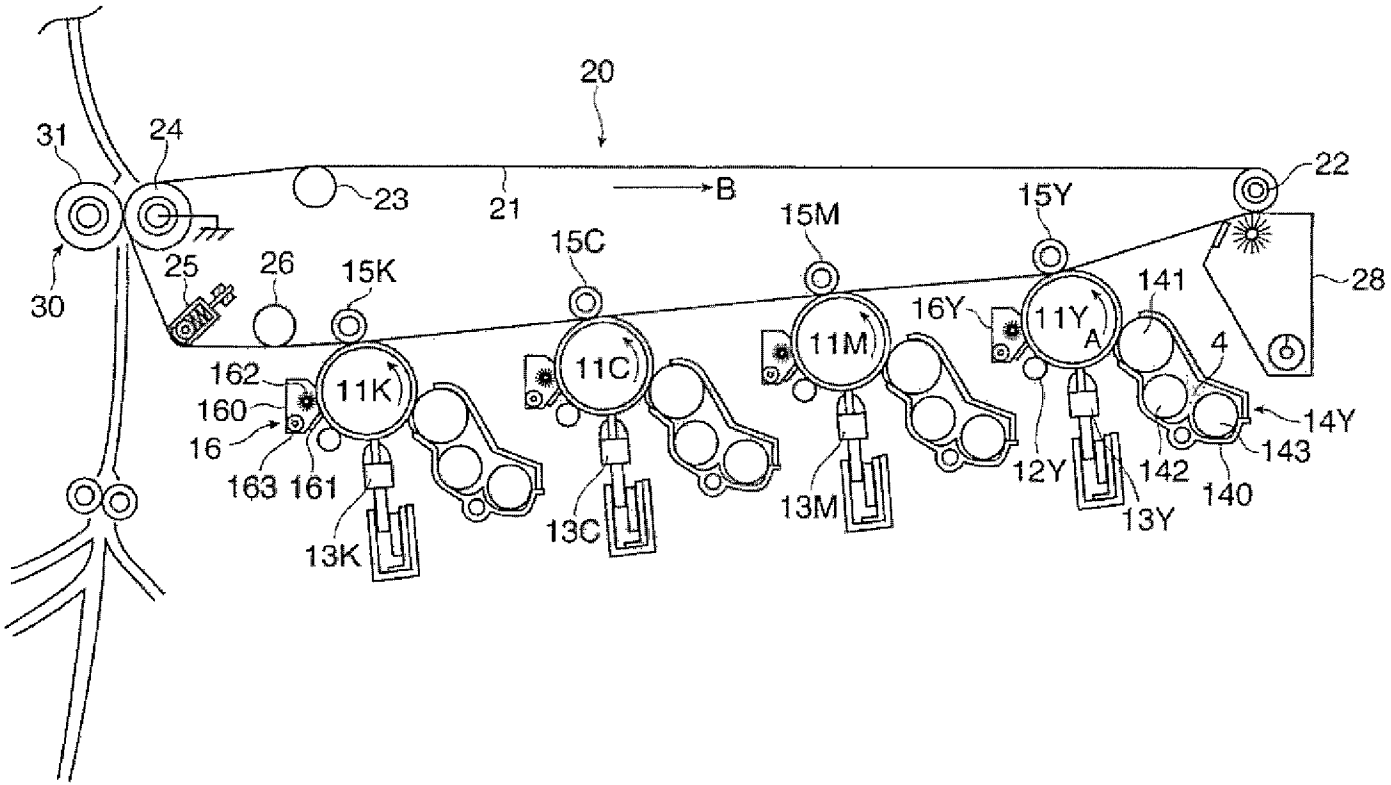
FIG. 2 is a configuration view showing an image forming section of the image forming apparatus related to Exemplary Embodiment 1 of the invention.

FIGS. 1 and 2 show an image forming apparatus as an example of an apparatus related to the Exemplary Embodiment 1. FIG. 1 shows the outline of the overall image forming apparatus, and FIG. 2 shows main parts (image forming devices and the like) in the image forming apparatus in an enlarged manner.

Configuration of Overall Image Forming Apparatus

The image forming apparatus 1 related to Exemplary Embodiment 1 is constituted as, for example, a color printer. The image forming apparatus 1 includes plural image forming devices 10 as image forming units that form toner images developed with toners that constitute developers 4, an intermediate transfer device 20 that holds the toner images formed by the respective image forming devices 10, respectively, and finally transports the toner images to a secondary transfer position where the toner images are secondarily transferred to recording sheet 5 as an example of a recording medium, a sheet feeder 50 that accommodates and transports the required recording sheet 5 to be supplied to the secondary transfer position of the intermediate transfer device 20, a fixing device 40 that fixes the toner images on the recording sheet 5 secondarily transferred by the intermediate transfer device 20, and motors as driving sources that drive these.

The image forming apparatus 1 may be constituted as for example, a color copying machine in a case where an image input device (not shown) that inputs an original image to be formed on the recording sheet 5 is added and provided. 1*a* in the drawing represents a body of the image forming apparatus, and the body 1*a* is formed by a supporting structure member, an outer cover, or the like.

The image forming devices 10 are constituted by four image forming devices 10Y, 10M, 10C, and 10K that exclusively form toner images in four colors of yellow (Y), magenta (M), cyan (C), and black (K), respectively. The four image forming devices 10 (Y, M, C, and K) are arranged so as to line up in a row in an internal space of the body 1*a*.

Each image forming device 10 (Y, M, C, or K), as shown in FIG. 1 or FIG. 2, has a rotating photoconductor drum 11, and the following respective devices are mainly arranged around the photoconductor drum 11. The main devices are a charging device 12 that charges the peripheral surface (image holding surface), on which an image may be formed, of the photoconductor drum 11 with a required potential, an exposure device 13 that irradiates the charged peripheral surface of the photoconductor drum 11 with light based on information on an image (signal) to form an electrostatic latent image (for each color) with a potential difference, a developing device 14 (Y, M, C, or K) that develops the electrostatic latent image with a toner of a developer 4 in a corresponding color (Y, M, C, or K) to form a toner image, a primary transfer device 15 that transfers each toner image to the intermediate transfer device 20, a drum cleaning device 16 that removes and cleans adhering matter adhering to the surface of the photoconductor drum 11, and the like.

The photoconductor drum 11 is provided by forming an image holding surface having a photoconductive layer (photosensitive layer) made of a photosensitive material on the peripheral surface of a cylindrical or columnar base material that is subjected to grounding treatment. The photoconductor drum 11 is supported so as to have power transmitted thereto from a rotation drive unit (not shown) and to rotate in a direction shown by arrow A.

The charging device 12 is constituted by a contact type charging device, such as a charging roll, which is arranged in contact with the photoconductor drum 11. The charging device 12 supplies a charging voltage to the charging roll. In a case where the developing device 14 is one that performs reversal development, as the charging voltage, the same polarity of voltage or current as the charging polarity of a toner supplied from the developing device 14 is supplied.

The exposure device 13 includes an LED array in which LED elements are arrayed along an axial direction of the photoconductor drum 11, and is one that irradiates the peripheral surface of the photoconductor drum 11 after being charged with a light beam configured according to information on an image input to the image forming apparatus 1, and forms an electrostatic latent image. Image information is input to a controller C of the image forming apparatus 1 from an external image information transmission device PC. This image information is converted into image information of yellow (Y), magenta (M), cyan (C), and black (K) and is transmitted to the exposure device 13 via a drive unit DL when a latent image is formed.

All the developing devices 14 (Y, M, C, and K), as shown in FIG. 2, are configured by arranging a developing roll 141 that holds a developer 4 inside a housing 140 in which an opening portion and an storage chamber of the developer 4 are formed, and transports the developer to a developing region that faces the photoconductor drum 11, agitating and transporting members 142 and 143, such as two screw augers, which transport the developer 4 while agitating the developer 4 so as to cause the developer to pass through the developing roll 141, a layer thickness regulating member (not shown) that regulates the amount (layer thickness) of the developer held by the developing roll 141, and the like. A development voltage is supplied from a power unit E to between the developing roll 141 and the photoconductor drum 11 in the developing device 14. Additionally, the developing roll 141 or the agitating and transporting members 142 and 143 have the power from the rotation drive unit (not shown) transmitted thereto and rotate in a required direction. Moreover, as the above four color developers 4 (Y, M, C, and K), two-component developers each containing a nonmagnetic toner and a magnetic carrier are used.

The primary transfer device 15 is a contact type transfer device including a primary transfer roll that rotates in contact with the peripheral surface of the photoconductor drum 11 and has a primary transfer voltage supplied thereto. As the primary transfer voltage, a direct-current voltage that shows polarity reverse to the charging polarity of a toner is supplied from the power unit E.

The drum cleaning device 16, as shown in FIG. 2, is constituted by a container-shaped body 160 of which a portion opens, a cleaning plate 161 that is arranged so as to come into contact with the peripheral surface of the photoconductor drum 11 after primary transfer with a required pressure, and removes and cleans adhering matter, such as residual toner, a rotary brush roll 162 that is arranged so as to rotate in contact with the peripheral surface of the photoconductor drum 11, further toward the upstream side in the rotational direction of the photoconductor drum 11 than the cleaning plate 161, a delivery member 163, such as a screw auger, that recovers adhering matter, such as toner removed by the cleaning plate 161 and transports to deliver the adhering matter to a recovery system (not shown), and the like. As the cleaning plate 161, a plate-shaped member (for example, blade) made of materials, such as rubber, is used.

The intermediate transfer device 20, as shown in FIG. 1, is arranged so as to be present at positions above the respective image forming devices 10 (Y, M, C, and K). The intermediate transfer device 20 is mainly constituted by the intermediate transfer belt 21 as an image holding belt that rotates in a direction shown by an arrow B while passing through the primary transfer position between the photoconductor drum 11 and the primary transfer device 15 (primary transfer roll), plural belt supporting rolls 22 to 26 that hold and rotatably support the intermediate transfer belt 21 in a desired state from the inner surface thereof, a secondary transfer device 30 that is arranged on the outer peripheral surface (image holding surface) side of the intermediate transfer belt 21 supported by the belt supporting roll 24, and secondarily transfers toner images on the intermediate transfer belt 21 to the recording sheet 5, and the belt cleaning device 28 that removes and cleans adhering matter, such as toner and paper debris, which remains on and adheres to the outer peripheral surface of the intermediate transfer belt 21 after passing through the secondary transfer device 30.

As the intermediate transfer belt 21, for example, an endless belt made of a material in which a resistance adjusting agent, such as carbon black, is dispersed in a synthetic resin, such as polyimide resin or polyamide resin, is used. Additionally, the belt supporting roll 22 is constituted as a driving roll, the belt supporting rolls 23 and 26 are constituted as driven rolls that hold the traveling position or the like of the intermediate transfer belt 21, the belt supporting roll 25 is constituted as a tensioning roll, and the belt supporting roll 24 is constituted as a secondary transfer back-up roll.

The secondary transfer device 30, as shown in FIG. 1, is constituted by a secondary transfer roll 31 that makes contact at a secondary transfer position that is an outer peripheral surface portion of the intermediate transfer belt 21 supported by the belt supporting roll 26 in the intermediate transfer device 20. Additionally, a direct-current voltage that shows a polarity reverse to or the same polarity as the charging polarity of a toner is supplied as a secondary transfer voltage to the secondary transfer roll 31 of the secondary transfer device 30 or the supporting roll 24 of the intermediate transfer device 20.

The fixing device 40 is configured by arranging, inside a housing 41 formed with an introduction port and an ejection port for the recording sheet 5, a roll-shaped heating rotary member 42 heated by a heating unit so as to rotate in a direction shown by an arrow and so that the surface temperature thereof is maintained at a predetermined temperature, a roll-shaped pressurizing rotary member 43 that rotates to follow the heating rotary member 42 in contact with the heating rotary member with a predetermined pressure substantially along the axial direction of the heating rotary member, and the like. In the fixing device 40, a contact portion where the heating rotary member 42 and the pressurizing rotary member 43 come into contact with each other becomes a fixing processing part that performs a required fixing process (heating and pressurization).

The sheet feeder 50 is arranged so as to be present at a position below the image forming devices 10. The sheet feeder 50 is mainly constituted by single (or plural) sheet accommodation members $\mathbf{51}_1$ to $\mathbf{51}_4$ that accommodate the recording sheet 5 of desired sizes, types, or the like, in a stacked state and a delivery device 52 that delivers the recording sheet 5 sheet by sheet from the sheet accommodation members $\mathbf{51}_1$ to $\mathbf{51}_4$. The sheet accommodation member 51 is attached, for example, so as to be able to be pulled out to the front surface (side surface that a user faces at the time of operation) side of the body 1*a*.

A sheet feeding and transporting device 59 as a transporting unit that is constituted by plural sheet transporting roll pairs 54 to 58 and a transporting and guiding member that transport the recording sheet 5, which is separated and delivered sheet by sheet by a sending-out roll and a separation pad as the delivery device 52 that delivers from the sheet feeder 50, to the secondary transfer position, is provided between the sheet feeder 50 and the secondary transfer device 30. The sheet transporting roll pair 58 arranged at a position immediately before the secondary transfer position in the sheet feeding and transporting device 59 is constituted as, for example, rolls (registration rolls) that adjust the transporting timing of the recording sheet 5 to adjust the position of the recording sheet 5 that reaches the secondary transfer position consequently.

A sheet ejection path 61 along which the recording sheet 5 is transported to a sheet ejection tray 60, and an upper connection path 62 as a transporting path along which the recording sheet 5 that is ejected in a reversed manner or with its image recording surface turned upward is transported are arranged on the upper side that is the downstream side in the transporting direction of the fixing device 40. A first gate 63 that switches a transporting path according to a transporting destination of the recording sheet 5 is arranged at a connecting portion between the sheet ejection path 61 and the upper connection path 62. Accordingly, in a case where a sheet is ejected to the ejection tray 60, the recording sheet 5 subjected to the fixing process is transported along the sheet ejection path 61, and is ejected to the sheet ejection tray 60 by a sheet ejection roll 64.

An optional ejection unit 65 as an additional medium ejection device is supported above the fixing device 40, and the optional ejection unit 65 has a face-down tray 66 that is arranged above the sheet ejection tray 60 and has the recording sheet stacked thereon with its image recording surface turned downward, similar to the sheet ejection tray 60, and a face-up tray 67 that has the recording sheets stacked thereon with its image recording surface turned upward. A reversal/ejection common path 68 as a transporting path that is connected to the upper connection path 62, a face-down ejection path 69 that is connected to the reversal/ejection common path 68 and sends the recording sheet 5 to the face-down tray 66, and a face-up transporting path 70 that is connected to the reversal/ejection common path 68 and sends the recording sheet 5 to the face-up tray 67 are provided inside the optional ejection unit 65. A second gate 71 that switches a transporting path according to a transporting destination of the recording sheet 5 is arranged at a connecting portion between the face-down ejection path 69 and the face-up transporting path 70. Accordingly, in a case where a sheet is ejected to the face-down tray 66, the recording sheet 5 subjected to the fixing processing is transported along the face-down ejection path 69, and is ejected to the face-down tray 66 by a sheet ejection roll 69*a*. Accordingly, in a case where a sheet is ejected to the face-up tray 67, the recording sheet 5 subjected to the fixing processing is transported along the face-up ejection path 70, and is ejected to the face-up tray 67 by a sheet ejection roll 70*a*.

Additionally, a reversal unit 72 as an additional unit is installed at a left portion of the image forming apparatus body 1*a*. A reversal transporting path 73 is formed along a vertical direction in the reversal unit 72, and reversal rolls 74, 75, and 76 that transport the recording sheet 5 downward are arranged at the reversal transporting path 73. An upper end portion of the reversal transporting path 73 is connected to an upper end portion of the upper connection path 62 via an upper transporting path 77, and a transporting roll 78 is arranged at a connection position between the upper transporting path 77 and the upper connection path 62. Additionally, a third gate 79 that switches a transporting path according to a transporting destination of the recording sheet 5 transported downward from the reversal/ejection common path 68 to the transporting roll 78 is arranged at a connecting portion between the upper transporting path 77 and the upper connection path 62. Additionally, a lower end portion of the reversal transporting path 73 is connected to the registration roll 58 via a lower transporting path 80.

The reversal unit 72 transports the recording sheet 5, which has an image formed on one surface thereof, to the face-down ejection path 69, and when the recording sheet is ejected to the face-down tray 66 by the ejection roll 69*a*, the reversal unit reverses the ejection roll 69*a* in a state where the ejection roll 69*a* pinches the rear end of the recording sheet 5, introduces the recording sheet 5 via the face-down ejection path 69 and the reversal/ejection common path 68 to the upper transporting path 77 by changing the transporting direction by the transporting roll 78 by the switching of the third gate 79, and transports the recording sheet to the registration roll 58 in a state where the back and front of the recording sheet is reversed via the reversal transporting path 73 and the lower transporting path 80.

Moreover, a manual sheet feeder 90 is mounted outside a lower end portion of the reversal unit 72 at the left portion of the image forming apparatus body 1*a*. The recording sheet 5 installed in the manual sheet feeder 90 is fed by a manual feed roll 91, and is transported to the registration roll 58 via a manual transporting path 92.

In addition, reference numerals 84Y, 84M, 84C, and 84K in FIG. 1 represent toner cartridges that contain toners in yellow (Y), magenta (M), cyan (C), and black (K).

Operation of Overall and Main Parts of Image Forming Apparatus

A basic image forming operation using the image forming apparatus 1 will be described below.

Here, an image forming operation when a full color image is configured by combining toner images in four colors (Y, M, C, and K) using the four image forming devices 10 (Y, M, C, and K) will be representatively described.

If the image forming apparatus 1 receives command information on a request for an image forming operation (printing), the four image forming devices 10 (Y, M, C, and K), the intermediate transfer device 20, the secondary transfer device 30, the fixing device 40, and the like start.

Then, in the image forming devices 10 (Y, M, C, and K), the respective photoconductor drums 11 first rotate in the direction shown by arrow A, and the charging devices 12 charge the surfaces of the respective photoconductor drums 11 with required polarity (negative polarity in Exemplary Embodiment 1) and potential, respectively. Subsequently, the exposure devices 13 irradiate the surfaces of the photoconductor drums 11 after the charging with light that is emitted on the basis of signals of an image obtained by converting information on the image input to the image forming apparatus 1 into respective color components (Y, M, C, and K), and form electrostatic latent images of the respective color components configured with a required potential difference on the surfaces of the photoconductor drums.

Subsequently, the respective developing devices 14 (Y, M, C, and K) supply corresponding toners in colors (Y, M, C, and K) charged with a required polarity (negative polarity) to the electrostatic latent images of the respective color components formed on the photoconductor drums 11 from the developing rolls 141, respectively, and cause the toners to adhere to the photoconductor drums electrostatically, thereby performing development. The electrostatic latent images of the respective color components formed on the respective photoconductor drums 11 are visualized as toner images in four colors (Y, M, C, and K) developed with corresponding color toners, respectively, by this development.

Subsequently, if the toner images in the respective colors formed on the photoconductor drums 11 of the respective image forming devices 10 (Y, M, C, and K) are transported to the primary transfer positions, the primary transfer devices 15 primarily transfer the toner images in the respective colors to the intermediate transfer belt 21 that rotates in the direction shown by arrow B of the intermediate transfer device 20 so that the toner images overlap each other in order.

Additionally, in the respective image forming devices 10 that have completed the primary transfer, the drum cleaning devices 16 clean to scrape off the adhering matter on the surfaces of the photoconductor drums 11. Thereby, the respective image forming devices 10 are brought into a state where the next image forming operation is possible.

Subsequently, in the intermediate transfer device 20, the toner images primarily transferred by the rotation of the intermediate transfer belt 21 are held, and are transported to the secondary transfer position. On the other hand, in the sheet feeder 50, a sheet of required recording sheet 5 is delivered to the sheet feeding and transporting device 59 in accordance with an image forming operation. In the sheet feeding and transporting device 59, the sheet transporting roll pair 58 as the registration roll delivers and supplies the recording sheet 5 to the secondary transfer position in accordance with transfer timing.

In the secondary transfer position, the secondary transfer device 30 collectively and secondarily transfers the toner images on the intermediate transfer belt 21 to the recording sheet 5. Additionally, in the intermediate transfer device 20 that has completed the secondary transfer, the belt cleaning device 28 removes and cleans adhering matter, such as toner that remains on the surface of the intermediate transfer belt 21 after the secondary transfer.

Subsequently, the recording sheet 5 to which the toner images are secondarily transferred is peeled off from the intermediate transfer belt 21 and the secondary transfer roll 31, and then transported to the fixing device 40. In the fixing device 40, required fixing processing (heating and pressurization) is performed to cause unfixed toner images to be fixed on the sheet 5 by introducing the recording sheet 5 after the secondary transfer into the contact portion between the rotating heating rotary member 42 and the pressurizing rotary member 43 to pass the recording sheet through the contact portion. Finally, the recording sheet 5 after the fixing is completed is ejected, for example, toward the face-down tray 60 installed in the upper part of the housing 1*a*, for example, by the sheet ejection roll 64 at the time of an image forming operation of only forming the images to one surface of the recording sheet.

The recording sheet 5 on which a full color image configured by combining the toner images in four colors are formed is output through the above operation.

Configuration of Characterizing Portion of Image Forming Apparatus

Figure 3:
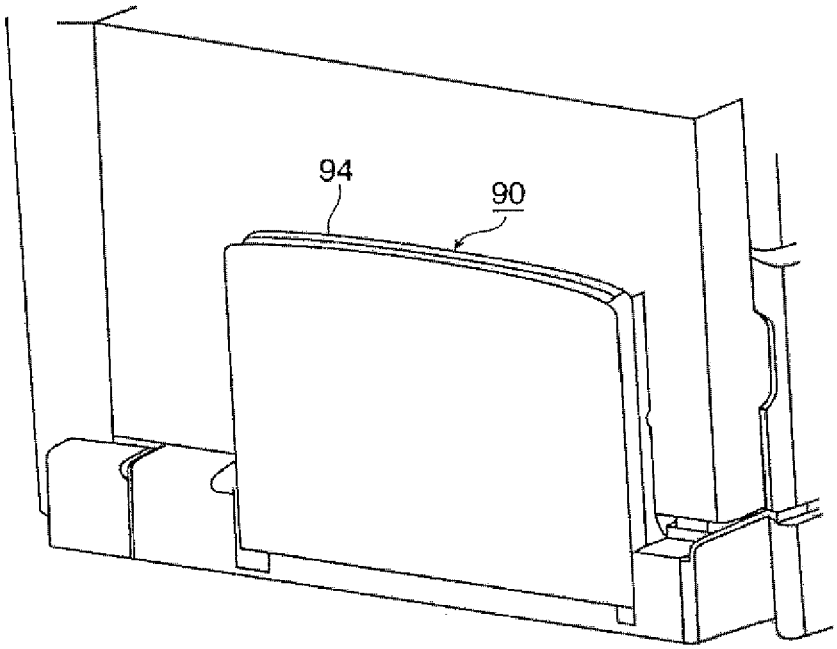
FIG. 3 is a perspective view of an appearance showing a manual sheet feeder.

Incidentally, in this exemplary embodiment, as shown in FIG. 1, a lower part of the reversal unit 72 of the left surface of the image forming apparatus body 1*a* is mounted with the manual sheet feeder 90. In a case where the image forming apparatus body 1*a* is not equipped with the reversal unit 72, the left surface of the image forming apparatus body 1*a* is equipped with the direct manual sheet feeder 90. The manual sheet feeder 90, as shown in FIG. 3, includes a manual feed tray (sheet tray) 94 as an opening and closing door that is foldably provided so as to be stored in the left surface of the image forming apparatus body 1*a* (the reversal unit 72 in the exemplary embodiment) in an upwardly erected state. The manual feed tray 94, as shown in FIG. 4, includes a manual feed tray body 95, and an extension tray 96 that is attached to the manual feed tray body 95 so as to be movable along a sheet feed direction.

An insertion port 97 into which the tip of the recording sheet 5 installed in the manual feed tray body 95 opens in the above image forming apparatus body 1*a*, and as shown in FIG. 1, the manual feed roll 91 as a sheet feed unit that feeds the recording sheet 5 inserted into the insertion port 97 in a state where the recording sheet is separated sheet by sheet is provided inside the image forming apparatus body 1*a*.

Figure 4:
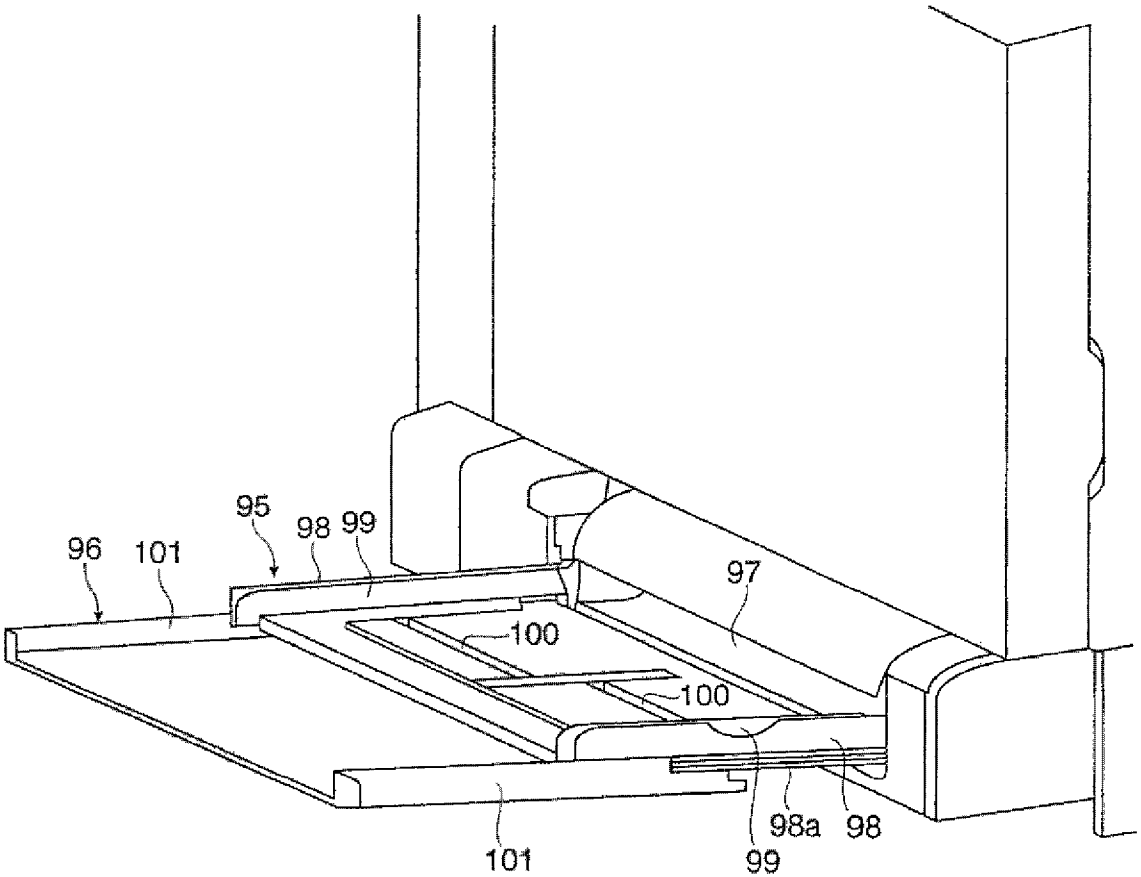
FIG. 4 is a perspective view of an appearance showing the usage state of the manual sheet feeder.

Additionally, as shown in FIG. 4, side walls 98 and 98 are integrally provided at both ends of the above manual feed tray body 95 in the direction intersecting the sheet feed direction, and side guides 99 and 99, which guide both ends of the recording sheet 5 arranged in the state of being placed on the upper surface of the manual feed tray body 95 according to the width of the recording sheet 5, are attached to the insides of both the side walls 98 and 98 so as to be movable in the direction intersecting the sheet feed direction. The above manual feed tray body 95 is configured so that the recording sheet 5 is fed with a central portion in the direction intersecting the sheet feed direction as a reference. In addition, in FIG. 5, reference numeral 100 represents guide grooves that guide the side guides 99 and 99.

Additionally, as shown in FIG. 4, the extension tray 96 is mounted on the lower surface of the above manual feed tray body 95 so as to be movable via guide grooves 98*a* and 98*a* provided in the outer surfaces of the side walls 98 and 98. In a case where a large size atypical recording sheet 5, such as an extended size A3 sheet that is slightly larger than a recording sheet of a typical A3 size is fed by the manual sheet feeder 90, the extension tray 96 may be pulled out from the manual feed tray body 95 so as to hold the large size atypical recording sheet 5 or the like. The above extension tray 96 is formed in the shape of a plate, and is integrally provided in a state where the side walls 101 and 101 are erected from both ends of the extension tray in the direction intersecting the sheet feed direction.

Figure 5:
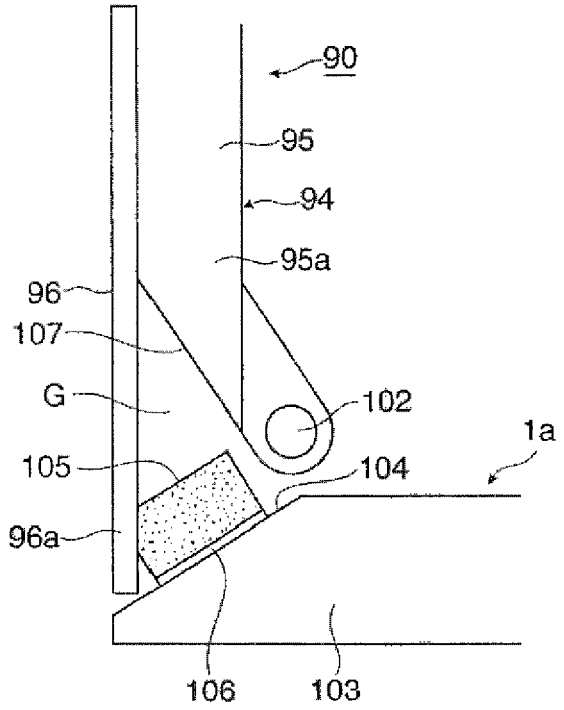
FIG. 5 is a configuration view showing the storage state of main parts of the manual sheet feeder.

The above manual feed tray body 95, as shown in FIG. 5, has a base end portion 95*a* attached to the image forming apparatus body 1*a* so as to be openable and closable about a rotating shaft 102 that is arranged along the horizontal direction, and is adapted to be openable and closable between a storage state where the manual feed tray body is erected so as to become substantially parallel to the side surface of the image forming apparatus body 1*a*, and a usage state where the manual feed tray body is substantially horizontally opened so as to intersect the side surface of the image forming apparatus body 1*a* about at 90 degrees with respect to the side surface.

An end portion 103 of the apparatus body 1*a* is provided at the body 1*a* of the image forming apparatus 1 so as to face an end portion 95*a* of the manual feed tray body 95 on the rotating shaft side via a gap G. An inclined surface 104 that inclines toward the outside of the image forming apparatus body 1*a* is formed at a position that faces the end portion of the manual feed tray body 95 in the end portion 103 of the apparatus body 1*a*, and an elastic member 105 as an elastic part with a rectangular cross-section that is made of a soft elastic body, such as urethane foam or silicone rubber, is attached to the inclined surface 104 by means of bonding or the like using double-sided tape 106. The elastic member 105 is provided over the whole width of the manual feed tray body 95 along a direction vertical to the drawing. Although the above inclined surface 104 is formed in an inclined state toward the outside of the image forming apparatus body 1*a*, the inclined surface is covered with the lower end portion 96*a* as a first portion of the extension tray 96 that has moved downward in a state where the manual feed tray 94 is stored.

Additionally, an inclined surface 107 is provided at a position corresponding to the inclined surface 104 on the image forming apparatus body 1*a* side, at the end portion 95*a* as a second portion that is different from the first portion of the manual feed tray body 95 on the rotating shaft side in the storage state, in the manual feed tray body 95. The inclined surface 107 becomes substantially parallel to the inclined surface 104 on the image forming apparatus body 1*a* side in a state where the manual feed tray body 95 is opened, and is brought into a state where the elastic member 105 is pressed by the inclined surface 107 and the inclined surface 104.

Operation of Characterizing Portion of Image Forming Apparatus

In the image forming apparatus related to this exemplary embodiment, it is possible to suppress leakage of sound from a gap of an opening and closing member and an occurrence of an impact sound at the time of operation, using a single member, as follows.

That is, in the image forming apparatus 1 related to this exemplary embodiment, as shown in FIG. 3, the manual feed tray 94 is stored in a state where the manual feed tray is erected and closed along the side surface of the image forming apparatus body 1*a* when the manual sheet feeder 90 is not used. In this state, as shown in FIG. 5, the extension tray 96 of the manual sheet feeder 90 is brought into a state where the extension tray has moved downward due to its own weight, and lower end portion 96*a* of the extension tray 96 comes into contact with the elastic member 105 on the image forming apparatus body 1*a* side, and blocks the gap G formed between the manual feed tray body 95 and the image forming apparatus body 1.

Therefore, when the manual sheet feeder 90 is not used, the gap G formed between the manual feed tray 90 and the image forming apparatus body 1*a* is blocked by the elastic member 105 that has elastically deformed, and this prevents or keeps the operating sound of the image forming apparatus 1 from leaking to the outside from the gap G between the manual sheet feeder 90 and the image forming apparatus body 1*a*.

Figure 6:
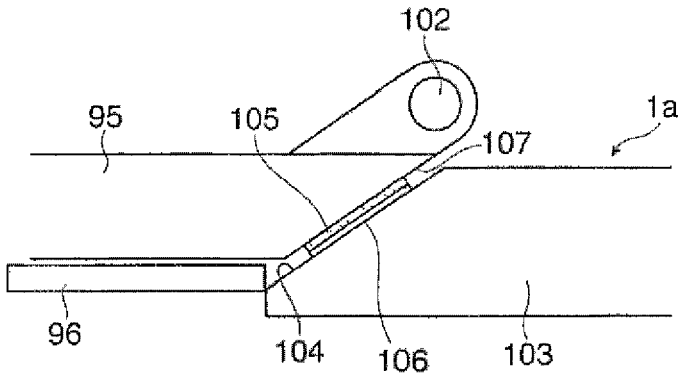
FIG. 6 is a configuration view showing the usage state of the main parts of the manual sheet feeder.

On the other hand, as shown in FIG. 6, when the manual sheet feeder 90 is used, the manual feed tray 95 is rotated by about 90 degrees in the counterclockwise direction from the side surface of the image forming apparatus body 1*a*, and brings the manual feed tray 95 into an opened state. In that case, the inclined surface 107 of the manual feed tray body 95 formed on the rotating shaft side is brought into a state where the inclined surface is brought into pressure contact with the elastic member 105 provided at the end portion 103 of the image forming apparatus body 1*a*. Therefore, when the manual feed tray body 95 is opened for use, a situation in which the inclined surface 107 of the manual feed tray body 95 comes into contact with the inclined surface 104 provided at the end portion 103 of the image forming apparatus body 1*a*, and generation of an impact sound may be suppressed and prevented.

Additionally, in this exemplary embodiment, as shown in FIG. 5, the elastic member 105 is attached to the inclined surface 104 provided at the end portion on the image forming apparatus body 1*a* side. Therefore, even in a case where the elastic member has received a pressing force by the lower end portion 96*a* of the extension tray 96, a pressing force caused by the extension tray 96 acts as a force that presses the elastic member 105 against the inclined surface 104 as a component force according to the angle of the inclined surface 104, the elastic member 105 is not easily peeled off, and durability is improved.

Additionally, in this exemplary embodiment, as shown in FIG. 6, the inclined surface 107 of the manual feed tray body 95 and the inclined surface 104 provided at the end portion 103 of the image forming apparatus body 1*a* face each other substantially parallel to each other in a state where the manual feed tray body 95 is opened. Therefore, the elastic member 105 substantially receives all the pressing forces from the inclined surface 107 of the manual feed tray body 95. As a result, a high shock-absorbing effect may be expected.

Exemplary Embodiment 2

Figure 7:
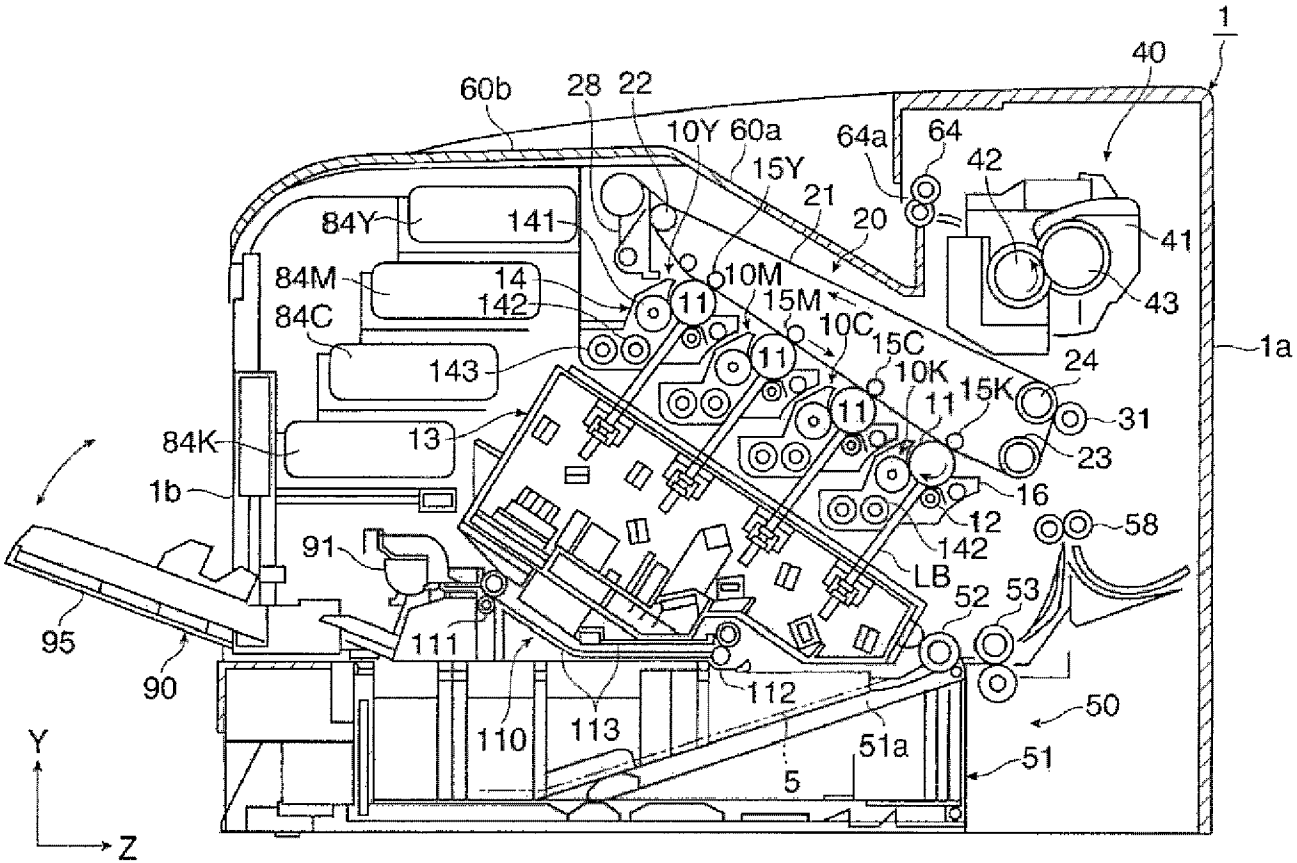
FIG. 7 is a schematic configuration view showing an image forming apparatus related to Exemplary Embodiment 2 of the invention.

FIG. 7 shows the outline of an image forming apparatus related to Exemplary Embodiment 2 of the invention, and the same portions as those of Exemplary Embodiment 1 will be designated and described by the same reference numerals. The image forming apparatus 1 related to Exemplary Embodiment 2 is constituted as, for example, a printer, and is one that forms an image on the basis of image information input from the outside, and lastly forms the image on the recording sheet 5 as a material to be recorded.

Configuration of Overall Image Forming Apparatus

The image forming apparatus 1 includes the body 1*a* of which the external shape is a substantially cubical box shape, and the following devices to be driven by a driving source are mainly arranged in the internal space of the body 1*a*. That is, the plural image forming devices 10 that form toner images configured with toners (powders subjected to coloring or the like) as developers on the basis of input image information, the belt type intermediate transfer device 20 that holds the toner images formed by the respective image forming devices 10, respectively, and finally secondarily transfers the toner images to the recording sheet 5, the sheet feeder 50 that accommodates and transports a required recording sheet 5 to be supplied to the secondary transfer position of the intermediate transfer device 20, the fixing device 40 that causes the recording sheet 5, to which the toner images are secondarily transferred by the intermediate transfer device 20, to pass therethrough, and perform fixing of the toner images, and the like are arranged in the internal space of the body 1*a*. As for the image forming devices 10, the intermediate transfer device 20, the sheet feeder 50, and the fixing device 40, the sheet feeder 50 is arranged in the lowermost part of the internal space of the body 1*a*, while the remaining image forming devices 10, intermediate transfer device 20, and fixing device 40 have the positional relationship of being arranged in a stacked state in that order in the internal space of the body 1*a* located above the sheet feeder 50.

The body 1*a* is a structure formed using various shapes of supporting members that constitute a framework portion of the image forming apparatus 1, and an outer cover that finally covers the framework portion and the like from the outside. An upper surface portion of the body 1*a* is formed with an ejection and accommodation section 60 that ejects and accommodates the recording sheet 5 on which an image is formed. The ejection and accommodation section 60 has an inclined surface portion 60*a*, and a horizontal surface portion 60*b* that continues from the inclined surface portion 60*a* and an upper end portion of the inclined surface portion 60*a*, and the recording sheet 5 after image formation is accommodated so as to be sequentially stacked on the inclined surface portion 60*a* and the horizontal surface portion 60*b*. Additionally, a sheet ejection port 64*a* to which the recording sheet 5 after image formation is ejected is formed in a wall surface portion of the body 1*a* that rises upward from a lower end portion of the inclined surface portion 60*b* of the ejection and accommodation section 60.

The image forming devices 10 are constituted by four image forming devices (10Y, 10M, 10C, and 10K) that exclusively form toner images in four colors of yellow (Y), magenta (M), cyan (C), and black (K). The four image forming devices 10 (Y, M, C, and K) include substantially common components as shown below, and are arranged so as to line up in series between the intermediate transfer device 20 and the sheet feeder 50.

Each image forming device 10 (Y, M, C, or K) has a rotating photoconductor drum 11, and the following respective devices are arranged around the photoconductor drum 11. The peripheral devices are a charging device 12 that charges an image holding surface (a surface portion that holds a toner image) of the photoconductor drum 11 with a required potential, an exposure device 13 that irradiates the charged image holding surface of the photoconductor drum 11 with light based on image information (signal) to form an electrostatic latent image (for each color) with a potential difference, a developing device 14 that develops the electrostatic latent image with a toner in a corresponding color (Y, M, C, or K) to form a toner image which is a visible image, a primary transfer device 15 that transfers the toner image to (the intermediate transfer belt 21 of) the intermediate transfer device 20, and a cleaning device 16 that scrapes off and cleans adhering matter, such as toner remaining and adhering to the image holding surface of the photoconductor drum 11 after the transfer.

The photoconductor drum 11 is provided by forming an image holding surface having a photoconductive layer (photosensitive layer) made of a photosensitive material on the peripheral surface of a cylindrical or columnar base material that is subjected to grounding treatment, and is supported by a supporting member of the body 1*a* so as to receive the power from a rotation drive unit (not shown) and rotates in a direction shown by an arrow. As the charging device 12, a contact type charging device including a contact member, such as a charging roll that is arranged in contact with the image holding surface of the photoconductor drum 11 and has a charging voltage applied thereto, is adopted. In a case where the developing device 14 is one that performs reversal development, as the charging voltage, the same polarity of voltage as the charging polarity of a toner supplied from the developing device is applied.

The exposure device 13 is configured so as to be collected in one housing with respect to the four image forming devices 10 (Y, M, C, and K), and individually emit light components corresponding to the photoconductor drums 11 of the respective image forming devices 10, and is arranged below the four developing devices 14. As the exposure device 13, a laser beam scan type exposure device is used.

The developing device 14 has a developer storage part that stores a developer (for example, a two-component developer containing a nonmagnetic toner and a magnetic carrier) in any one color of the above four colors (Y, M, C, and K), and has a developing roll 141 that holds the developer stored in the developer storage part while rotating the developer and transports the developer to a developing region that faces the photoconductor drum 11, and agitating and transporting members 142 and 143 that rotates the stored developer while agitating the developer, and transports the developer to the developing roll 141. Additionally, in the developing device 14, a development voltage including a direct-current component on which an alternating-current component is superimposed is applied to the developing roll 141, and the developing roll 141 and the agitating and transporting members 142 and 143 are rotated in a required direction. The toner of the developer is agitated within the developer storage part by the agitating and transporting members 142 and 143, and thereby frictionally charged with a required polarity (a negative polarity in the exemplary embodiment) by rubbing against the carrier. Moreover, the developing device 14 is replenished with a developer (a developer containing only a toner and a developer containing a toner and a carrier) in a required color from the developer cartridge 84 (Y, M, C, or K) according to the consumption amount of the developer.

As the primary transfer device 15, a contact type transfer device including a primary transfer roll that rotates in contact with the image holding surface of the photoconductor drum 11 via the intermediate transfer belt 21, and has a primary transfer voltage applied thereto is used. In the primary transfer device 15, a voltage (a direct-current voltage having a polarity reverse to the charging polarity of a toner) of a direct-current component is applied to the primary transfer roll as the primary transfer voltage. Incidentally, the primary transfer roll of the primary transfer device 15 is supported on the supporting member side of the intermediate transfer device 20.

The intermediate transfer device 20 is mainly constituted by the endless intermediate transfer belt 21 that rotates in a direction shown by an arrow while passing through the primary transfer position between the photoconductor drum 11 and the primary transfer device 15 (primary transfer roll) in each image forming device 10 (Y, M, C, or K), plural supporting rolls 22 to 24 that rotatably support the intermediate transfer belt 21 from the inner peripheral surface thereof, a secondary transfer roll 31 that rotates in contact with the outer peripheral surface of the intermediate transfer belt 21 supported by the supporting roll 24 with a predetermined pressure, and a belt cleaning device 28 that removes toner or the like, which remains on and adheres to the outer peripheral surface of the intermediate transfer belt 21 after passing through the secondary transfer roll 31.

As the intermediate transfer belt 21, for example, an intermediate transfer belt formed from an endless belt having a required thickness using a material in which a conductivity imparting agent, such as carbon, is dispersed in a synthetic resin, such as polyimide resin or polyamide resin, is used. The supporting roll 22 is constituted as a driving roll, the supporting roll 23 is constituted as a tensioning roll, and, the supporting roll 24 is constituted as a facing roll of the secondary transfer section. Among these, a secondary transfer voltage including a direct-current component having the same polarity (or reverse polarity) as the charging polarity of a toner is applied to the supporting roll 24 at a required timing. As for the secondary transfer voltage, a direct-current component of a polarity reverse to the charging polarity of a toner may be applied to the secondary transfer roll 31.

As the sheet feeder, the accommodation type sheet feeder 50 and a manual type sheet feeder 90 as will be described below are used. The two types of sheet feeders 50 and 90 are arbitrarily selected and used.

The accommodation type sheet feeder 50 is arranged in a state where the sheet feeder is present below the exposure device 13 in a lower part of the internal space of the body 1*a*. The sheet feeder 50 is mainly constituted by a box-shaped sheet accommodation member 51 (sheet cassette) that is attached so as to be capable of being pulled out from a side surface portion of the front surface of the body 1*a*, and accommodates the recording sheet 5 of desired sizes, types, or the like, in a stacked state, and a delivery device 52 that delivers the recording sheet 5 accommodated in the sheet accommodation member 51 sheet by sheet from upper sheets. The front surface of the body 1*a* is a side surface set so as to turn to a user when the image forming apparatus 1 is installed, and corresponds to a left side surface shown in FIG. 7 in Exemplary Embodiment 2. Additionally, the above delivery device 52 is constituted by a sending-out roll that sends out upper recording sheets 5, and a separating pad that separates only one uppermost sheet in the sending-out sheet 5. The sheet accommodation member 51 includes a stack plate 51*a* that moves up and down while the recording sheet 5 is placed thereon.

A sheet transporting path for sheet feeding that transports the recording sheet 5 delivered from the sheet feeder 50 to the secondary transfer position is provided in a portion between the delivery device 52 of the sheet feeder 50, and the secondary transfer positions (the position where the intermediate transfer belt 21 and the secondary transfer roll 31 come into contact with each other) of the intermediate transfer device 20 in the internal space of the body 1*a*. The sheet transporting path for sheet feeding is constituted by the sheet transporting roll pair 58, the transporting and guiding member, and the like. Among these, the sheet transporting roll pair 58 is constituted as a feed-in adjusting roll pair that has, for example, a function of adjusting the transporting timing or transporting posture of the recording sheet 5.

The fixing device 40 is arranged in a state where the fixing device is present above the secondary transfer position in the intermediate transfer device 20. The fixing device 40 is configured by arranging, inside the housing 41, a heating roll 42 heated by a heating unit so as to rotate in a direction shown by an arrow and so that the surface temperature thereof is maintained at a predetermined temperature, and a pressurizing rotary member 43 of a roll type, a belt type, or the like that rotates to follow the heating roll 42 in contact with the heating roll with a predetermined pressure substantially along the axial direction of the heating roll. A transporting and guiding member that is not shown is arranged between the fixing device 40 and the secondary transfer section of the intermediate transfer device 20, and the recording sheet ejected from the secondary transfer section is guided by the transporting and guiding member so as to be introduced into the fixing device 40. Additionally, a sheet transporting path for ejection that transports and ejects the recording sheet 5 after the fixing that is ejected from the fixing device 40 to the ejection and accommodation section 60 is provided between the fixing device 40 and the ejection and accommodation section 60 (sheet ejection port 64*a*). The sheet transporting path for ejection is constituted by the sheet transporting roll pair 64, the transporting and guiding member, and the like.

Operation Regarding Image Formation

Formation of a basic image by the image forming apparatus 1 is performed as follows.

First, in the image forming apparatus 1, for example, an operation pattern (full color mode) in which a full color image configured by combining toner images in four colors (Y, M, C, and K) formed using all the four image forming devices 10 (Y, M, C, and K) is formed, and an operation pattern (monochrome mode) in which a monochrome image configured with a toner image in one color formed using one of the four image forming devices 10 (Y, M, C, and K) is formed may be selected and performed. The monochrome mode in Exemplary Embodiment 2 is set as a black-and-white mode in which a black-and-white image configured with a toner image in a black color (K) is formed.

Here, an image forming operation when the full color mode is selected will be described.

In this case, first, in the four image forming devices 10 (Y, M, C, and K), the respective photoconductor drums 11 rotate in the direction of an arrow, and the respective charging devices 12 charge the image holding surfaces of the respective photoconductor drums 11, respectively, with required polarity (for example, negative polarity in Exemplary Embodiment 2) and potential. Additionally, the exposure devices 13 perform exposure (scanning exposure of a laser beam LB) based on image signals decomposed into respective color components (Y, M, C, and K) on the photoconductor drum 11 after the charging, and form electrostatic latent images in the respective color components configured with a predetermined potential difference, respectively. Moreover, the respective developing devices 14 supply toners in respective colors (Y, M, C, and K) charged with a required polarity (negative polarity) using the developing roll 141 to the electrostatic latent images of the respective color components formed on the photoconductor drums 11 and cause the toners to adhere to the photoconductor drums electrostatically, thereby performing visualization (development) as toner images.

Next, in the respective image forming devices 10 (Y, M, C, and K), the toner images in the respective colors formed on the photoconductor drum 11 are primarily transferred sequentially to the intermediate transfer belt 21 by transfer electric fields formed by the primary transfer devices 15, and are overlapped with each other, at the primary transfer positions where the respective photoconductor drums 11 and the intermediate transfer belt 21 of the intermediate transfer device 20 come into contact with each other. Subsequently, in the intermediate transfer device 20, the toner images primarily transferred to the intermediate transfer belt 21 are secondarily transferred to the recording sheet 5 transported via the sheet transporting path for sheet feeding from the sheet feeder 50 by a transfer electric field formed by the secondary transfer roll 31 at the secondary transfer position.

The recording sheet 5 that has completed the secondary transfer is peeled off from the intermediate transfer belt 21, and then is moved toward and introduced into the fixing device 40. In the fixing device 40, the toners of the toner images are melted and fixed on the sheet 5 by causing the recording sheet 5, on which the toner images are transferred, to pass through the contact portion between the heating roll 42 and the pressurizing rotary member 43, and heating and pressurizing the contact portion. The recording sheet 5 after the fixing is completed is ejected to the outside of the body 1*a* from the sheet ejection port 64*a* via the sheet transporting path for ejection and is accommodated in the ejection and accommodation section 60, in a case where image formation is performed on one surface.

As above, a full color image configured by combining the toner images in four colors is formed on one recording sheet 9.

Configuration of Characterizing Portion of Image Forming Apparatus

Incidentally, in Exemplary Embodiment 2, the left surface of the image forming apparatus body 1*a* includes a manual sheet feeder 90.

The manual sheet feeder 90, as shown in FIG. 7, is constituted by a plate-shaped manual feed tray body 95 as an opening and closing door that installs a required number of recording sheets 5 by hand, a delivery device 91 that feeds the recording sheet 5 installed in the manual feed tray body 95 sheet by sheet from upper sheets, and a sheet transporting path 110 for manual sheet feeding that places the recording sheet 5 delivered from the delivery device 91 on the stack plate 51*a* of a sheet feeder 50, and transports the recording sheet to the near side of the delivery device 52. The manual feed tray body 95 is rotatably attached to a side surface portion 1*b* of the front surface of the body 1*a* with a tray lower end portion as a supporting point, and is used in a state where the manual feed tray body obliquely falls toward the outside from the side surface portion 1*b* of the front surface. The delivery device 91 is constituted by a delivery roll 91*a* and a separation roll 91*b* that separates sheets. The sheet transporting path 110 is formed by a first sheet transporting roll pair 111 that is arranged on the upstream side in the sheet transporting direction, and a second sheet transporting roll pair 112 that is arranged on the downstream side in the sheet transporting path, and a transporting and guiding pair 113 that forms a transporting path space.

In a case where sheet feeding is performed and selected from the manual sheet feeder 90, the sheet feeding is performed as follows. That is, in the manual sheet feeder 90, upper sheets in plural recording sheets 5 placed on the manual feed tray body 95 is delivered sheet by sheet to a sheet transporting path 110 for manual sheet feeding by the delivery roll 91*a* of the delivery device. In the sheet transporting and guiding path 110, the delivered recording sheet 5 is transported so as to pass through the transporting path space of the transporting guide pair 113 of the transporting force of the first sheet transporting roll pair 111 and the second sheet transporting roll pair 112, and then, the tip portion of the sheet 5 is put on the stack plate 51*a* of the sheet feeder 50 (or the upper surface of the accommodated recording sheet 5). Thereafter, the recording sheet 5 is transported to the secondary transfer position through the sheet transporting path for sheet feeding by being delivered by the delivery device 52 of the sheet feeder 50.

Figure 8:
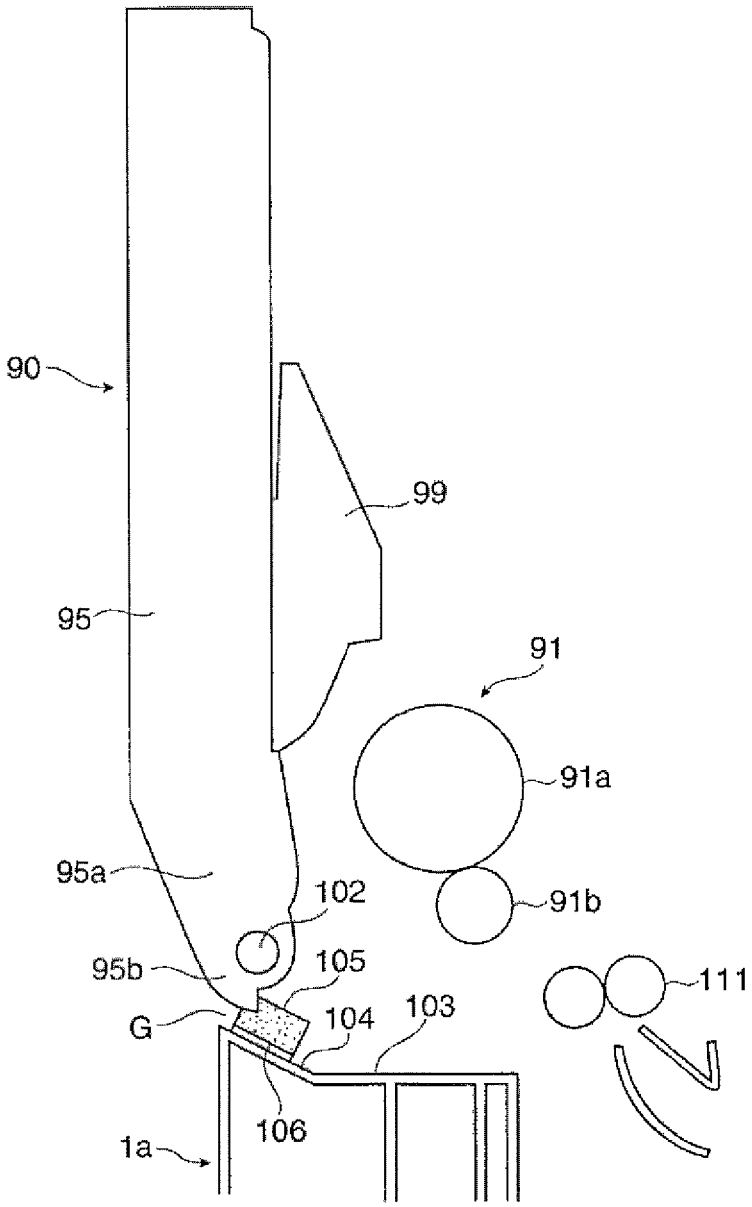
FIG. 8 is a configuration view showing the storage state of a manual sheet feeder.

The above manual feed tray body 95, as shown in FIG. 8, is attached to the image forming apparatus body 1*a* so as to be openable and closable about the rotating shaft 102 of which a base end portion 95*a* is arranged along the horizontal direction. The base end portion 95*a* of the manual feed tray body 95 is formed in a shape in which the outer surface thereof inclines toward the rotating shaft 102, and the outer peripheral portion 95*b* of the rotating shaft 102 forms a shape that is bent or curved to the position of the lower end portion of the rotating shaft 102.

The end portion 103 of the apparatus body is provided at the body 1*a* of the image forming apparatus 1 so that the apparatus body faces the base end portion 95*a* of the manual feed tray body 95 on the rotating shaft side via the gap G. The inclined surface 104 that inclines toward the inside of the image forming apparatus body 1*a* is formed at a position that faces the base end portion 95*a* of the manual feed tray body 95 in the end portion 103, and the elastic member 105 with a rectangular cross-section that is made of a soft elastic body, such as urethane foam or silicone rubber, is attached to the inclined surface 104 by means of bonding or the like using the double-sided tape 106. The above inclined surface 104 is formed in a state where the inclined surface inclines toward the inside of the image forming apparatus body 1*a*, and is covered with the manual feed tray body 95 in a storage state, and the elastic member 105 is configured to be difficult to view from the outside.

Operation of Characterizing Portion of Image Forming Apparatus

In the image forming apparatus related to this Exemplary Embodiment 2, it is possible to suppress leakage of sound from the gap of the opening and closing member and an occurrence of an impact sound at the time of operation, using a single member, as follows.

That is, in the image forming apparatus 1 related to this Exemplary Embodiment 2, as shown in FIG. 8, the manual feed tray body 95 is stored in a state where the manual feed tray body is erected along the side surface of the image forming apparatus body 1*a* when the manual sheet feeder 90 is not used. In this state, the end portion 95*b* of the manual feed tray body 95 of the manual sheet feeder 90 that is located on the rotating shaft 102 side comes into contact with the elastic member 105 on the image forming apparatus body 1*a* side, and blocks the gap G formed between the manual feed tray body 95 and the image forming apparatus body 1.

Therefore, when the manual sheet feeder 90 is not used, the gap G formed between the manual feed tray body 95 and the image forming apparatus body 1*a* is blocked by the elastic member 105, and this prevents or keeps the operating sound of the image forming apparatus 1 from leaking to the outside from the gap G between the manual feed tray body 95 and the image forming apparatus body 1*a*.

Figure 9:
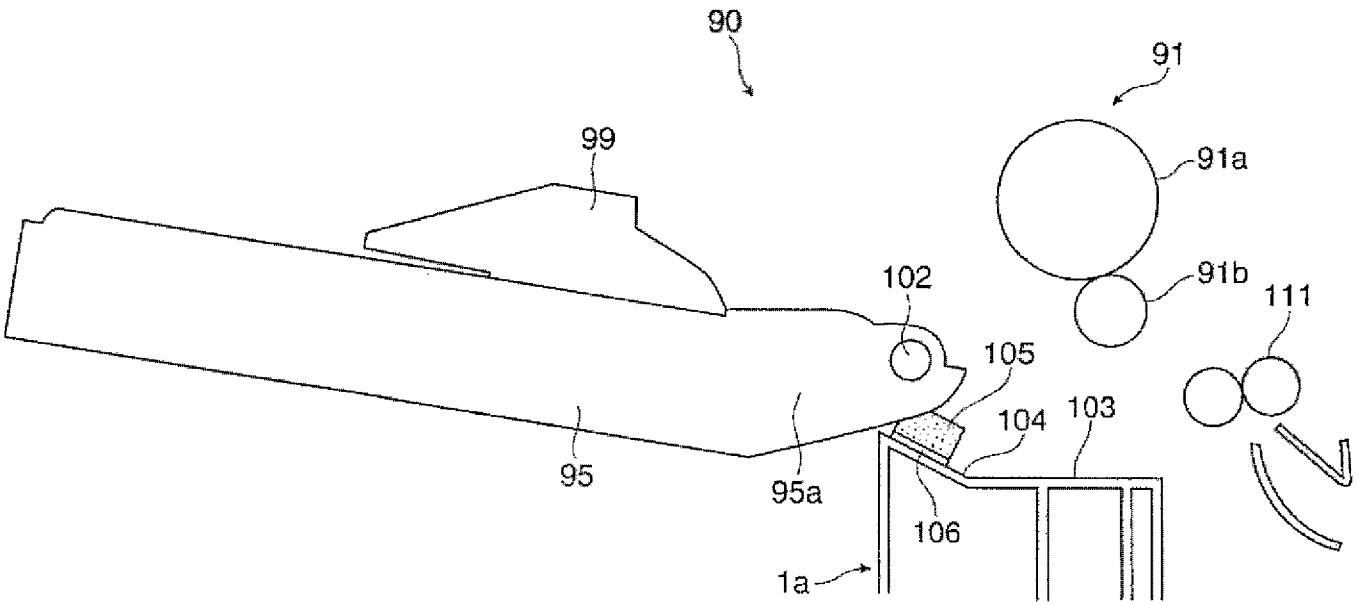
FIG. 9 is a configuration view showing the usage state of the manual sheet feeder.

On the other hand, as shown in FIG. 9, when the manual sheet feeder 90 is used, the manual feed tray body 95 is rotated by about 90 degrees in the counterclockwise direction from the side surface of the image forming apparatus body 1*a*, and brings the manual feed tray body 95 into an opened state. In that case, the end portion 95*b* of the manual feed tray body 95 on the rotating shaft side is brought into a state where the end portion is brought into pressure contact with the elastic member 105 provided at the end portion 103 of the image forming apparatus body 1*a*. Therefore, when the manual feed tray body 95 is opened for use, a situation in which the end portion 95*b* of the manual feed tray body 95 abuts against the inclined surface 104 provided at the end portion 103 of the image forming apparatus body 1*a*, and generation of an impact sound may be suppressed and prevented.

Exemplary Embodiment 3

Figure 10:
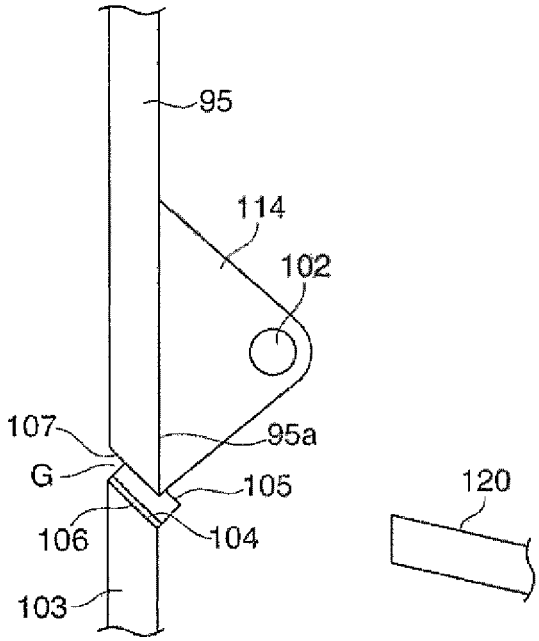
FIG. 10 is a configuration view showing the storage state of a manual sheet feeder of an image forming apparatus related to Exemplary Embodiment 3 of the invention.

FIG. 10 shows Exemplary Embodiment 3 of the invention. If the same portions as those of the above exemplary embodiments are designated and described by the same reference numerals, in the present exemplary embodiment, the rotating shaft that openably and closably supports the opening and closing member is arranged above the gap formed between the opening and closing member and the end portion on the image forming apparatus body side, and is configured so as to be formed in a state where the inclined surface provided at the end portion inclines toward the inside of the image forming apparatus body.

Configuration of Characterizing Portion of Image Forming Apparatus

That is, in Exemplary Embodiment 3, as shown in FIG. 10, the rotating shaft 102 that openably and closably supports the manual feed tray body 95 as an opening and closing member is arranged via a supporting member 114 at a position higher than the gap G located between the manual feed tray body 95 and the end portion 103. The inclined surface 104 that inclines toward the inside of the image forming apparatus 1 is formed at the upper end portion of the end portion 103 that faces the manual feed tray body 95 on the image forming apparatus body 1*a* side, and the elastic member 105 that blocks the gap G formed between the manual feed tray body 95 and the end portion 103 of the image forming apparatus body 1*a* is provided at the inclined surface 104 by means of bonding or the like using the double-sided tape 106. Additionally, the inclined surface 104 is formed in a state where the inclined surface inclines toward the inside of the image forming apparatus 1, and the elastic member 105 provided at the inclined surface 104 is configured so as to be difficult to view from the outside.

Additionally, the inclined surface 107 of the end portion 103 that faces the inclined surface 104 is formed at the lower end portion of the above manual feed tray body 95 in a state where the inclined surface inclines toward the outside of the image forming apparatus body 1*a*. The surface of the elastic member 105 is set so as to incline toward the outside from the rotational track of the manual feed tray body 95. The reason is as follows. That is, when the manual feed tray body 95 is rotated in an opening direction, the manual feed tray body moves in a circular-arc shape about the rotating shaft 102 so that an outer end portion of the inclined surface 107 of the manual feed tray body 95 comes into pressure contact with the elastic member 105. Therefore, the manual feed tray body does not enter the rotational track and a contact portion between the outer end portion of the inclined surface 107 and the elastic member 105 decreases. Thus, operation is kept from becoming heavy due to the pressure of the elastic member 105. Moreover, the internal distance of the image forming apparatus body 1*a* may be set to be wider than the outer distance thereof. Then, a situation in which the outer end portion of the inclined surface 107 of the manual feed tray body 95 comes into pressure contact with the inclined surface 104 of the end portion 103 via the elastic member 105 is avoided, and the manual feed tray body 95 becomes smoothly rotatable.

In addition, in FIG. 10, reference numeral 120 represents a plate-like transporting member that transports the recording sheet 5 fed from the manual feed tray body 95.

Operation of Characterizing Portion of Image Forming Apparatus

In the image forming apparatus related to this Exemplary Embodiment 3, it is possible to suppress leakage of sound from the gap of the opening and closing member and occurrence of an impact sound at the time of operation, using a single member, as follows.

That is, in the image forming apparatus 1 related to this Exemplary Embodiment 3, as shown in FIG. 10, the manual feed tray body 95 is stored in a state where the manual feed tray body is erected along the side surface of the image forming apparatus body (not shown) when the manual sheet feeder 90 is not used. In this state, the end portion 95*a* of the manual feed tray body 95 of the manual sheet feeder 90 that is located on the rotating shaft 102 side comes into contact with the elastic member 105 on the image forming apparatus body 1*a* side, and blocks the gap G formed between the manual feed tray body 95 and the image forming apparatus body 1.

Therefore, when the manual sheet feeder 90 is not used, the gap G formed between the manual feed tray body 95 and the image forming apparatus body 1*a* is blocked by the elastic member 105, and this prevents or keeps the operating sound of the image forming apparatus 1 from leaking to the outside from the gap G between the manual feed tray body 95 and the image forming apparatus body 1*a*.

Figure 11:
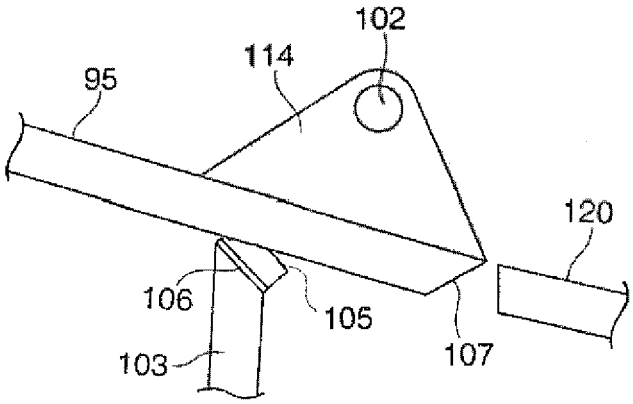
FIG. 11 is a configuration view showing the usage state of the manual sheet feeder of the image forming apparatus related to Exemplary Embodiment 3 of the invention.

On the other hand, as shown in FIG. 11, when the manual sheet feeder 90 is used, the manual feed tray body 95 is rotated in the counterclockwise direction from the side surface of the image forming apparatus body (not shown), and brings the manual feed tray body 95 into an opened state. In that case, the end portion 95*a* of the manual feed tray body 95 on the rotating shaft is brought into a state where the inclined surface is brought into pressure contact with the elastic member 105 provided at the end portion 103 of the image forming apparatus body 1*a*. Therefore, when the manual feed tray body 95 is opened for use, a situation in which the end portion 95*a* of the manual feed tray body 95 abuts against the inclined surface 104 provided at the end portion 103 of the image forming apparatus body, and generation of an impact sound may be suppressed and prevented.

In addition, in the above exemplary embodiments, a case where the opening and closing door is applied to the manual feed tray 94 has been described. However, the opening and closing member is not limited to the manual feed tray, and it is natural that the opening and closing member may also be similarly applied to a sheet ejection tray provided so as to be openable and closable with respect to the image forming apparatus body, a cover that is opened, for example, at the time of jam clearance, or the like.

Additionally, in the above exemplary embodiments, the image forming apparatus has been described as the apparatus having the driving source. However, the apparatus is not limited to the image forming apparatus, and it is natural that other apparatuses may be adopted so long as the apparatuses are apparatuses having a driving source, and including an opening and closing door that is opened and closed by rotational operation about a rotating shaft with respect to a body of each apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An apparatus comprising:

a device that includes a driving source;

an opening and closing door that is opened and closed by rotational operation about a rotating shaft with respect to a body of the apparatus; and an elastic part that is provided at the body of the apparatus, that is elastically deformed by contact with a first portion of a part of the opening and closing door on a side of the rotating shaft and blocks a gap between the first portion and the body of the apparatus when the opening and closing door is closed, and that is elastically deformed by contact with a second portion of the opening and closing door that is different from the first portion when the opening and closing door is opened, wherein the apparatus is an image forming apparatus, and wherein the elastic part in the open state inclines so that the second portion comes into contact with the surface of the elastic part parallel thereto.

2. The apparatus according to claim 1, wherein the opening and closing door is a sheet tray that accommodates sheets, and wherein the second portion of or the sheet tray in the open state inclines so that the second portion comes into contact with the surface of the elastic part parallel thereto.

3. The apparatus according to claim 2, wherein a portion that sticks the elastic part to the body of the apparatus is parallel to the second portion when the sheet tray is opened.

4. The apparatus according to claim 2, wherein the elastic part inclines toward the outside of a rotational track of the first portion so that a size of a portion where the first portion of the sheet tray comes into contact with the elastic part changes during the opening and closing operation of the opening and closing door.

* * * * *